US005114387A

United States Patent [19]

Keppler

[11] Patent Number: 5,114,387

[45] Date of Patent: May 19, 1992

[54] EXERCISE APPARATUS

[76] Inventor: Louis Keppler, 17529 Fairfax La., Strongsville, Ohio 44136

[21] Appl. No.: 659,845

[22] Filed: Feb. 22, 1991

[51] Int. Cl.[5] ..... A63B 23/04

[52] U.S. Cl. ..... 482/51; 482/148; 434/253

[58] Field of Search ..... 272/70, 93, 3, 56.5 SS, 272/97; 434/253; 273/1 B, 3 R, 8, 30, 51, 1 R, 285, 286, 287

[56] References Cited

U.S. PATENT DOCUMENTS 4,779,862 10/1988 Keppler ..... 272/70

4,940,226 7/1990 Carra ..... 272/70

*Primary Examiner*—Stephen R. Crow

*Attorney, Agent, or Firm*—Tarolli, Sundheim & Covell

[57] ABSTRACT

An exercise apparatus for a skater or similar athlete includes a flexible sheet having a smooth glide surface along which the feet of the exerciser can slide. Bumper assemblies are releasably connected with opposite ends of the flexible sheet. The flexible sheet is releasably clamped between a rigid base plate and a main section of a bumper assembly. A ramp section is releasably connected with the main section of a bumper assembly. A resiliently compressible bumper strip is provided on an upwardly sloping side surface of the ramp section to engage the foot of the exerciser. To further absorb forces resulting from enagagement of an exerciser's foot against the ramp section, a pad is provided between the ramp section and the main section of a bumper assembly. A mat extends beneath the flexible sheet and ramp section of a bumper assembly to stabilize the bumper assembly.

11 Claims, 3 Drawing Sheets

EXERCISE APPARATUS

BACKGROUND OF THE INVENTION

The present invention relates to an improved exercise apparatus and more specifically to an exercise apparatus in which bumper assemblies are provided at opposite ends of a sheet to engage the feet of a person sliding on a smooth upper side surface of the sheet.

A known exercise apparatus for a speed skater or similar athlete is disclosed in U.S. Pat. No. 4,779,862 issued Oct. 25, 1988 and entitled "Exercising Apparatus for Skaters". This known apparatus includes a base formed by a plurality of boards arranged in a side-by-side relationship. The boards are interconnected by hinges. A flexible sheet having a smooth upper glide surface is placed on the base formed by the boards. Bumper assemblies clamp opposite ends of the sheet to the base.

A skater or other exerciser using this known apparatus wears socks over suitable shoes. The exerciser then gets on the glide sheet and pushes against one bumper with one foot and slides along the sheet until the other foot hits the opposite bumper. The exerciser then pushes off from the second bumper and slides back toward the first bumper. This sliding movement between the bumpers is repeated until the exercises ar completed.

Although this known apparatus has been generally satisfactory, difficulty has been encountered in storing the apparatus due to the use of a plurality of boards as a base for the flexible sheet. In addition, impact forces against the sides of an exerciser's foot by engagement with the bumper assemblies may tend to cause some discomfort after extended use of the apparatus.

SUMMARY OF THE INVENTION

The present invention relates to a new and improved exercise apparatus for use in training for skating and/or other sports. The apparatus includes a flexible sheet having a smooth glide surface along which the feet of an exerciser can slide. Bumper assemblies are releasably connected with opposite end portions of the flexible sheet. During use of the apparatus, the feet of an exerciser slide on the sheet and engage first one bumper assembly and then the opposite bumper assembly.

Each of the bumper assemblies includes a rigid base member which is disposed beneath the flexible sheet and a rigid main section which is disposed above the sheet. The base and main section of a bumper assembly are releasably interconnected to clamp the flexible sheet between the base and main section of the bumper assembly.

In order to reduce forces resulting from impact of the feet of an exerciser with bumper assemblies, each of the bumper assemblies includes a ramp section having an upwardly sloping side surface which is engaged by the foot of an exerciser using the apparatus. The upwardly sloping side surface of the ramp section gradually stops the sideward movement of the foot with minimal impact force.

To further minimize impact force against the feet of an exerciser using the apparatus, the ramp section of each bumper assembly is provided with a resiliently compressible bumper strip. The bumper strip is engaged by the foot of the exerciser and is compressed somewhat by the foot. In addition, a pad is provided between the ramp section and the main section of the bumper assembly to cushion sideward forces transmitted from the ramp section to the main section of the bumper assembly. The ramp section is releasably connected with the main section and pad to enable ramp sections having different slopes to be used with the main section of a bumper assembly.

To stabilize the bumper assembly and flexible sheet, a mat with upper and lower side surfaces having a relatively high coefficient of friction, is connected with the base of the bumper assembly. The mat extends from beneath the bumper assembly along the flexible sheet so that the weight of an exerciser presses the flexible sheet against the mat and in turn presses the mat against the floor or other support surface. This enables forces to be transmitted from the bumper assembly to the floor when the exerciser's foot engages the bumper assembly.

When an exerciser using the apparatus has completed the exercises, the apparatus can be compactly stored. This may be done by disconnecting one of the bumper assemblies from the flexible sheet. The flexible sheet is then rolled around the other bumper assembly. The flexible sheet, with one of the bumper assemblies connected thereto, and the disconnected bumper assembly can then be stored in a minimum of space. Although the use of the flexible sheet facilitates storage a rigid sheet or base could be used if desired.

Accordingly, it is an object of this invention to provide a new and improved apparatus for use in training for skating and other sports and wherein the apparatus includes a flexible sheet having a glide surface and bumper assemblies at opposite ends of the sheet to engage the feet of an exerciser sliding on the flexible sheet, each of the bumper assemblies is releasably connected with the flexible sheet and has a ramp section with a side surface which slopes upwardly from the glide surface on the flexible sheet to engage the side of a foot of an exerciser.

Another object of this invention is to provide a new and improved exercise apparatus for use in training for skating and other sports, the exercise apparatus includes a flexible sheet and bumper assemblies connected with opposite end portions of the flexible sheet, the apparatus being capable of being stored by disconnecting one of the bumper assemblies from the flexible sheet and rolling the flexible sheet around the other bumper assembly.

BRIEF DESCRIPTION OF THE DRAWINGS

The foregoing and other objects and features of the present invention will become more apparent upon a consideration of the following description taken in connection with the accompanying drawings, wherein.

DESCRIPTION OF ONE SPECIFIC PREFERRED EMBODIMENT OF THE INVENTION

Figure 1:
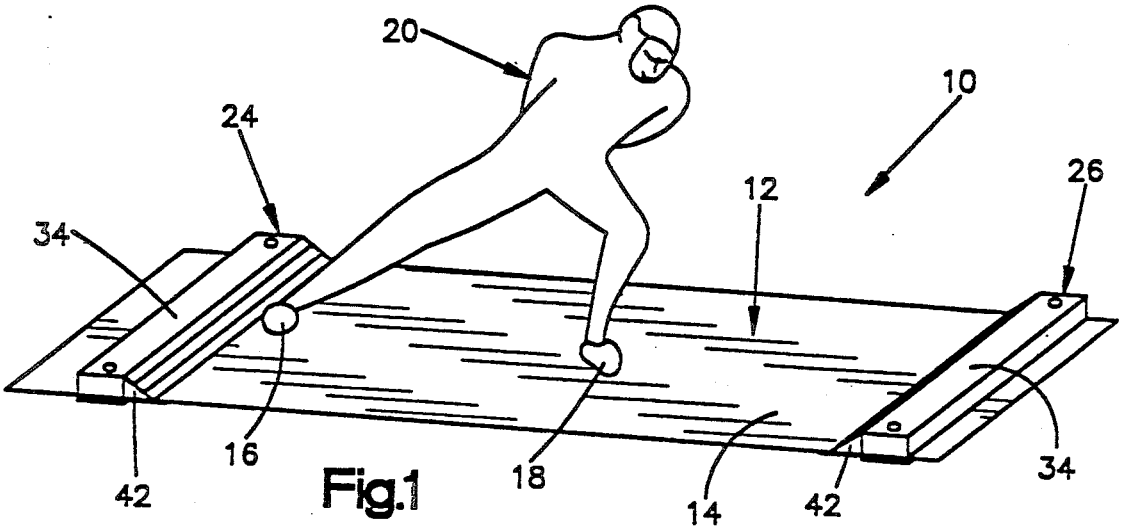
FIG. 1 is a somewhat schematicized pictorial illustration depicting the use of the exercise apparatus of the present invention.

An exercising apparatus 10 (FIG. 1) constructed in accordance with the present invention includes a flexible sheet 12. The flexible sheet 12 has a smooth glide surface 14 along which the feet 16 and 18 of an exerciser 20 slide during use of the apparatus 10. Identical bumper assemblies 24 and 26 are releasably connected with opposite end portions of the flexible sheet 12. During use of the exercising apparatus 10, the feet 16 and 18 of the exerciser 20 impact against one of the bumper assemblies 24 or 26 and then against the other bumper assembly as the exerciser slides along the flexible sheet 12 across a glide area 25 between the bumper assemblies.

The flexible plastic sheet 12 is rigid enough to transmit forces applied by gliding movement of the sock covered feet of an exerciser to the bumper assemblies 24 and 26. Thus, friction forces applied against the sheet 12 are transmitted by the sheet to the bumper assemblies 24 and 26 without forming wrinkles in the sheet. In one specific embodiment of the invention, the flexible plastic sheet 12 had a thickness of approximately ⅛ of an inch, a length between bumper assemblies 24 and 26 of approximately 8 feet and a width of approximately 2 feet. If desired, a rigid sheet or board could be substituted for the flexible sheet 12 or the flexible sheet could be mounted on a rigid base.

The bumper assembly 26 (FIG. 2) includes a rigid metal base plate 30 which is disposed beneath a lower side surface 32 of the flexible sheet 12. A rigid main section or block 34 is disposed in engagement with the upper surface 14 of the flexible sheet 12. Fasteners 36 and 38 releasably interconnect the base plate 30 and the wooden main section 34 of the bumper assembly.

When the fasteners 36 and 38 are connected, the flexible plastic sheet 12 is firmly clamped between a flat upwardly facing major side surface of the base plate and a flat downwardly facing major side surface of the main section 34 of the bumper assembly to hold the bumper assembly against movement along the flexible sheet 12. When the fastener assemblies 36 and 38 are released, the bumper assembly 26 can be moved along the longitudinal axis of the flexible sheet 12 to increase the distance between the bumper assemblies 24 and 26 (FIG. 1).

In addition, when the fastener assemblies 36 and 38 (FIG. 2) are released, the bumper assembly 26 can be angled relative to the sheet. This may be done to accommodate different angular orientations of the foot 18 of the exerciser 20 using the apparatus 10. When the exercising apparatus 10 is to be stored, the fasteners 36 and 38 can be released to enable the bumper assembly 26 to be removed from one end of the flexible sheet.

Figure 2:
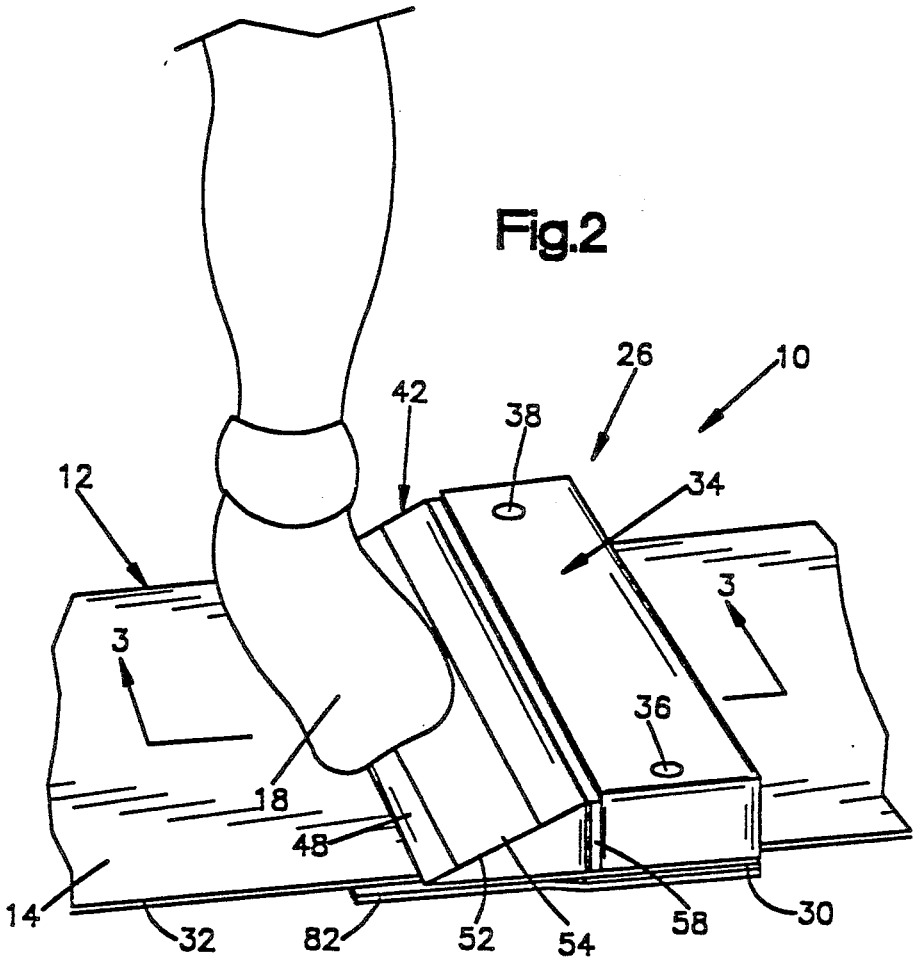
FIG. 2 is an enlarged pictorial illustration of a bumper assembly of the apparatus of FIG. 1 and illustrating the manner in which the foot of an exerciser engages the bumper assembly.
Figure 3:
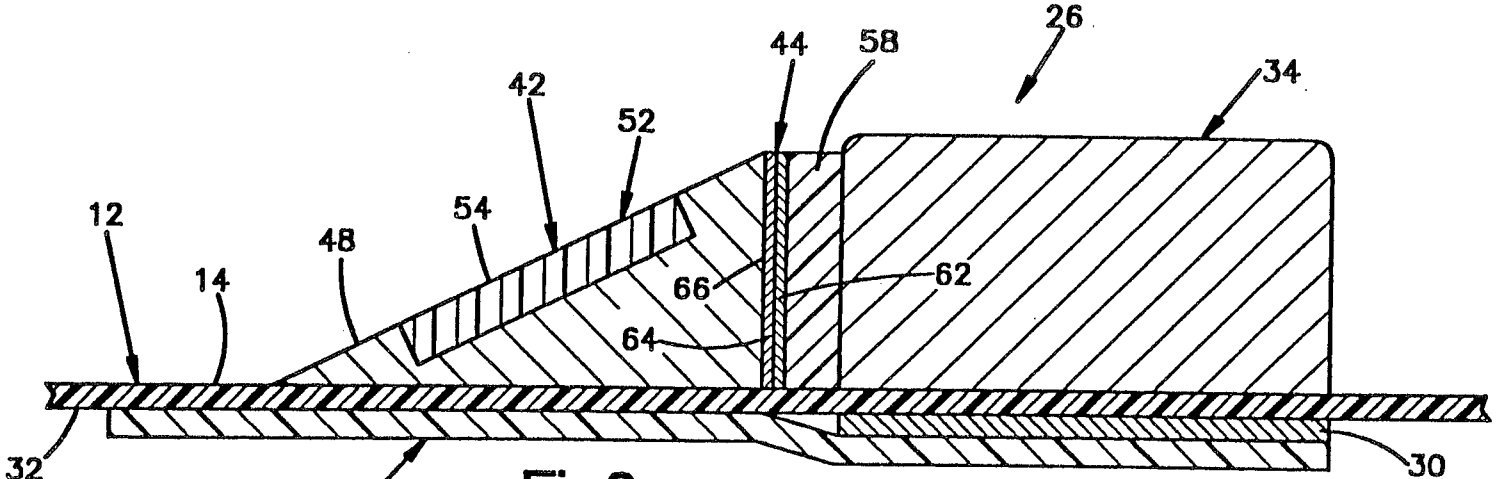
FIG. 3 is a sectional view, taken generally along the line 3—3 of FIG. 2, further illustrating the construction of the bumper assembly.

In accordance with one of the features of the present invention, the bumper assembly 26 includes a ramp section 42 (FIGS. 2 and 3). The ramp section 42 is releasably connected with the main section 34 of the bumper assembly by a connector 44 (FIG. 3). The rigid wooden ramp section 42 of the bumper assembly 26 has a side surface 48 which slopes upwardly away from the upper side surface 14 of the flexible sheet 12 toward the main section 34 of the bumper assembly.

When a foot 18 (FIG. 2) of a person using the exercising apparatus moves into engagement with the bumper assembly 26, the foot slides up the side surface 48 of the ramp section 42 to gradually retard sideward movement of the foot with a minimum of impact between the foot and the bumper assembly. In addition to providing for the gradual transfer of energy from the moving foot of the exerciser 10 and the bumper assembly 26, the ramp section 42 provides an inclined surface 48 for the foot 18 of the exerciser to push off against as the exerciser starts to slide toward the opposite bumper assembly, that is, toward the bumper assembly 24 (FIG. 1).

To cushion the engagement of the foot 18 with the rigid ramp section 42 (FIG. 2) and to provide a relatively high coefficient of friction to facilitate pushing off against the ramp section 42, the ramp section is provided with a resiliently compressible bumper or impact strip 52 (FIGS. 2 and 3). The impact strip 52 is formed of a resiliently compressible, rubber-like polymeric material which is readily compressed by the foot 18 as the foot slides up the ramp surface 48. Thus, the bumper strip 52 is resiliently compressed to absorb impact forces between the foot 18 and the bumper assembly 26. In addition, the relatively high coefficient of friction of the outer side surface 54 of the bumper strip 52 is effective to decelerate the foot 18 and to provide a solid surface for the foot to push off against.

To further absorb the impact forces between the foot 18 and the bumper assembly 26, the bumper assembly is provided with a pad 58 (FIG. 3) between the ramp section 42 and the main section 34 of the bumper assembly 26. The pad 18 is formed of a resiliently compressible polymeric material. The pad 58 may have a foam-like construction with small voids or spaces to accommodate compression of the pad.

When the foot 18 (FIG. 2) engages the ramp section 42, sideward force is transmitted from the ramp section to the pad 58 to compress the pad and absorb the sideward forces. Of course, the forces are transmitted from the pad 58 to the main section 34 of the bumper assembly 26. The main section 34 of the bumper assembly 26 is firmly clamped to the flexible sheet 12 by the base plate 30 so that the bumper assembly 26 does not move relative to the flexible sheet 12 when the foot 18 engages the ramp section 42.

It is contemplated that it may be desired to change the slope of the ramp section 42. Thus, in the embodiment illustrated in FIG. 3, the upper side surface 48 of the ramp section 42 extends at an angle of approximately 25° to the glide surface 14 on the flexible sheet 12. When it is desired to change the angle between the upper side surface 48 of the ramp section 42 and the glide surface 14 of the flexible sheet 12, the ramp section is disconnected from the main section 34 of the bumper assembly 26. A new ramp section, having the desired angle, is then connected with the main section 34 of the bumper assembly 26.

To facilitate connection and disconnection of various ramp sections 42 from the main section 34, a releasable connector 44 is provided between the ramp section 42 and main section 34. The releasable connector 44 is of the hook and loop type and is commercially available under the trademark VELCRO®. A strip 62 of hooks is secured to the outer side surface of the pad 58 by a suitable adhesive. Similarly, a strip 64 of loops is secured to the vertically extending end surface 66 of the ramp section 42 by a suitable adhesive. Of course, the strip 64 of hooks could be connected with the pad 58 and the strip 62 of loops could be connected with the ramp section 42 if desired. In addition, it is contemplated that other known types of releasable connectors could be used to interconnect the ramp section 42 and main section 34 of the bumper assembly 26.

Figure 4:
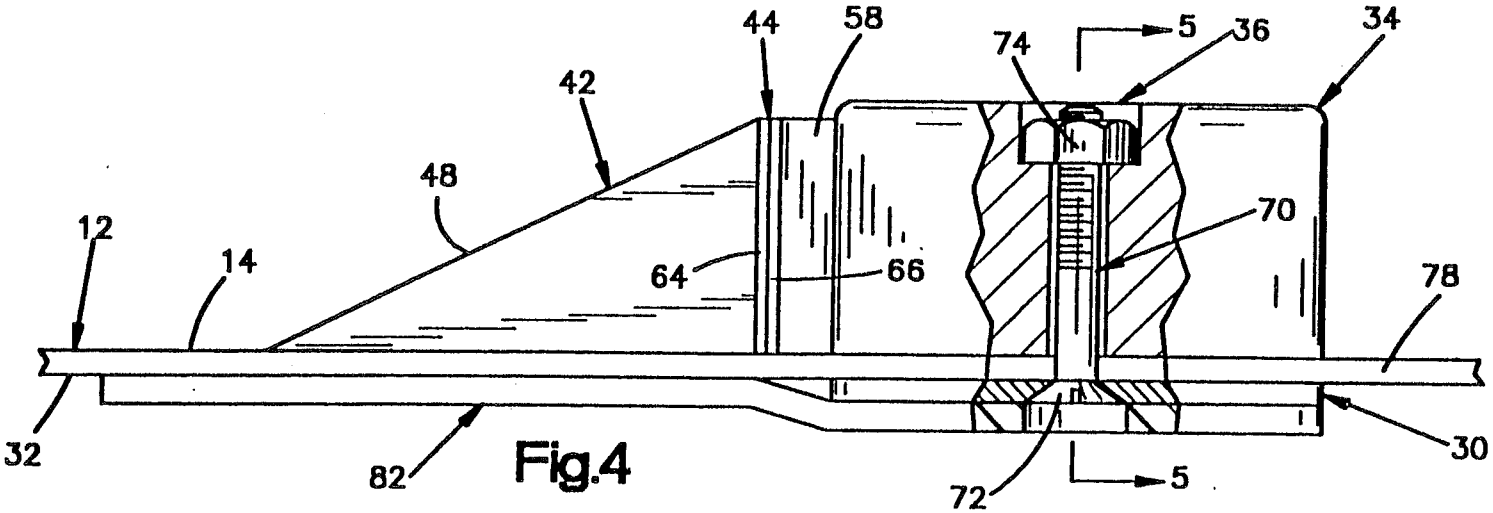
FIG. 4 is a partially broken away end view of the bumper assembly, illustrating the manner in which the flexible sheet is clamped between a main section and base plate of the bumper assembly.

The rigid metal base plate 30 is connected to the rigid wooden main section 34 of the bumper assembly 26 by a fastener 36 (FIG. 4). The fastener 36 includes a metal bolt 70 having a head end portion 72 which engages a countersunk opening in the base plate 30. A metal nut 74 engages a threaded upper (as viewed in FIG. 4) end portion of the bolt 70 to interconnect the main section 34 and base plate 30. By tightening the fastener 36, the flexible sheet 12 is firmly clamped between the base plate 30 and main section 34. Although only the fastener 36 has been shown in FIG. 4, it should be understood that the fastener 38 (FIG. 2) has the same construction as the fastener 36.

The fasteners 36 and 38 are spaced apart by a distance which is greater than the width of the flexible sheet 12. Therefore, the fasteners 36 and 38 do not extend through the flexible sheet 12. Thus, the fastener 36 is disposed outwardly (toward the right as viewed in FIG. 5) of the longitudinally extending edge 78 of the flexible sheet 12. Similarly, the fastener 38 is disposed outwardly of the opposite longitudinal extending edge of the flexible sheet 12.

Figure 5:
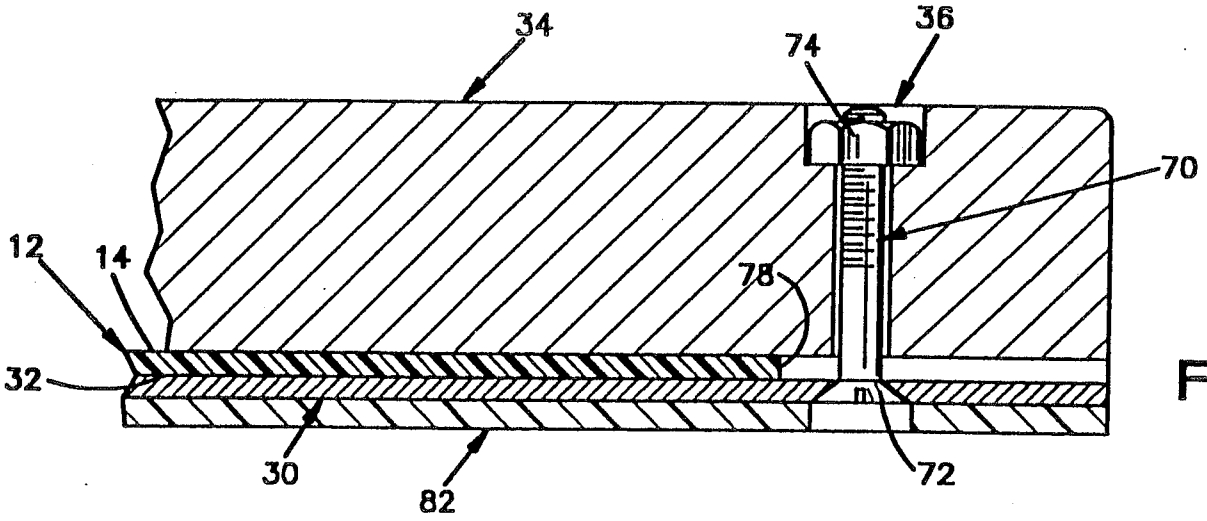
FIG. 5 is a sectional view, taken generally along the line 5—5 of FIG. 4, further illustrating the manner in which the flexible sheet is clamped between the base plate and main section of the bumper assembly.

An anti-skid mat 82 of rubber or similar polymeric material is fixedly secured to the bottom of the base plate 30 (FIGS. 4 and 5). The flexible mat 82 extends from the base plate 30 past the ramp section 42. Thus, the anti-skid mat 82 extends from beneath the main section 34 of the bumper assembly 26, beneath the ramp section 42, and beneath the lower side 32 of the flexible sheet 12 past the ramp section (FIG. 2). This results in the flexible sheet 12 being pressed against the flexible rubber mat 82 by the foot 18 of the person using the exercise apparatus.

The mat 82 has major side surfaces with a relatively high coefficient of friction. This enables the mat 82 to cooperate with a support surface for the exercise apparatus 10 to stabilize the bumper assembly 26 and hold the bumper assembly against movement. Since the foot 18 of an exerciser (FIG. 2) presses directly downwardly on the flexible sheet 12 to press the flexible sheet against the mat 82, there is minimal tendency for the bumper assembly and the flexible sheet to shift or move relative to the floor or other support surface upon which they are disposed. If desired, an anti-skid material could be provided on the bottom of the flexible sheet 12 in place of the mat 82.

When the exercise apparatus 10 is to be used, a person who is to exercise with the apparatus put socks over suitable exercise shoes. The socks provide the shoes with a surface having a low coefficient of friction to enable the feet of the person to slide over the upper surface 14 of the flexible sheet 12. Of course, the person using the exercise apparatus could have shoes with soles which would slide easily over the sheet 12, thereby eliminating the need for putting socks over the shoes.

The exerciser then gets on the flexible sheet 12, in the manner illustrated schematically in FIG. 1. The exerciser pushes against the bumper assembly 24 with one foot, that is, the right foot 16. As the exerciser pushes off from the bumper assembly 24, the other foot, that is, the left foot 18, slides along the upper side surface 14 of the flexible sheet 12 across the glide area 25 toward the opposite bumper assembly 26. The left foot 18 slides into engagement with the opposite bumper assembly 26 to limit sideward movement of the exerciser.

The exerciser then pushes off from the bumper assembly 26 with his left foot 18 and slides back across the glide area 25 toward the bumper assembly 24. When the right foot 16 engages the bumper assembly 24, he again pushes off to repeat the sliding movement across the smooth upper side surface 14 of the flexible sheet 12. Sliding movement of the exerciser between the bumper assemblies 24 and 26 is repeated until the exercises are completed.

When a foot, for example the left foot 18, of the exerciser engages the bumper assembly 26, the foot slides up the sloping side surface 48 of the ramp section 42 (FIG. 2). As this occurs, leftward forces applied against the bumper assembly 26 are dissipated with a minimum of shock loading or impact forces against the foot 18. To further minimize impact forces against the foot 18, the resilient bumper strip 52 is compressed. In addition, the resilient pad 18 is compressed. Due to the combined effect of the upward slope of the side surface 48 of the ramp section 42, the resilient bumper strip 52 and the resilient pad 58, the foot 18 is subjected to very low impact forces.

The high coefficient of friction of the upper side surface 54 of the bumper strip 52 enables the person to firmly push off against the ramp section 42 of the bumper assembly 26 toward the bumper assembly 24. Since the ramp section 42 slopes upwardly, the incline of the ramp section promotes engagement of the foot 18 with a relatively large surface area of the ramp section to provide for solid engagement between the foot 18 and the bumper assembly 26 as the foot pushes off toward the opposite bumper assembly. Although only the bumper assembly 26 has been illustrated in FIGS. 2–5, it should be understood that the bumper assembly 24 has the same construction as the bumper assembly 26. The bumper assembly 24 cooperates with the other foot 16 of the person using the apparatus in the same manner as in which the bumper assembly 26 cooperates with the foot 18.

When the person using the exercise apparatus 10 has completed his exercises, the flexible sheet 12 can be rolled up for storage in a minimum of space. It is contemplated that the exercise apparatus will be stored by first disconnecting one of the bumper assemblies, for example, the bumper assembly 26, from the flexible sheet 12. To disconnect the bumper assembly 26 from the flexible sheet 12, the fasteners 36 and 38 are loosened. The bumper assembly 26 is then slid longitudinally along the sheet 12 until it is disengaged from the sheet.

Figure 6:
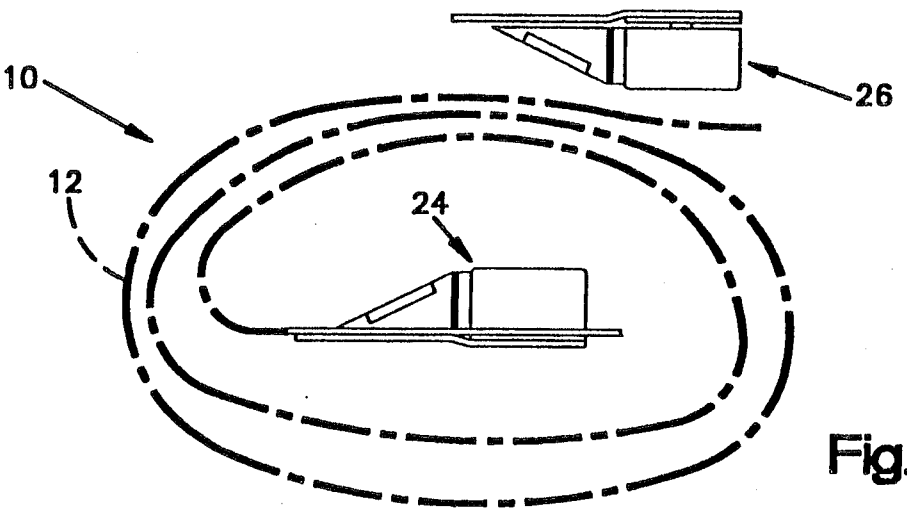
FIG. 6 is an illustration depicting the manner in which the exercise apparatus may be stored by disconnecting one of the bumper assemblies from the flexible sheet and rolling the flexible sheet around the other bumper assembly.

Once the bumper assembly 26 has been disconnected from the flexible sheet 12, the sheet is rolled around bumper assembly 24 (FIG. 6). The bumper assembly 24, with the flexible sheet rolled therearound, and the bumper assembly 26 can be stored in a relatively small space in a bag or other suitable manner.

When the exercise apparatus 10 is to be subsequently used, the apparatus is removed from its storage bag or other location. The flexible sheet 12 is unwrapped from around the bumper assembly 24. The free end of the flexible sheet is then threaded between the base 30 and main section 34 of the bumper assembly 26.

When the bumper assembly 26 has been moved along the flexible sheet 12 to a desired location relative to the bumper assembly 24, the fastener assemblies 36 and 38 are tightened to securely interconnect the sheet 12 and bumper assembly 26 with a clamping action. If desired, the bumper assemblies 24 and 26 could be connected with the sheet 12 with the longitudinal axes of the bumper assemblies skewed slightly relative to the longitudinal axes of the sheet 12.

In view of the foregoing description, it is apparent that the present invention relates to a new and improved exercise apparatus 10 for use in training for skating and/or other sports. The exercise apparatus 10 includes a flexible sheet 12 having a smooth glide surface 14 along which the feet 16 and 18 of an exerciser 20 can slide. Bumper assemblies 24 and 26 are releasably connected with opposite end portions of the flexible sheet 12. During use of the apparatus, the feet 16 and 18 of an exerciser sliding on the sheet 12 engages first one bumper assembly 24 and then the opposite bumper assembly 26 as the exerciser glides along the sheet 12 between the bumper assemblies.

Each of the bumper assemblies 24 and 26 includes a rigid base member 30 which is disposed beneath the flexible sheet 12 and a rigid main section 34 which is disposed above the sheet. The base and main sections 30 and 34 of each bumper assembly are releasably interconnected to clamp the sheet 12.

In order to reduce forces resulting from impact of the feet 16 and 18 of an exerciser with the bumper assemblies 24 and 26, each of the bumper assemblies include a ramp section 42 having an upwardly sloping side surface 48 which is engaged by the foot of an exerciser. The upwardly sloping side surface 48 of the ramp section 42 gradually stops the sideward movement of a foot 18 with minimal impact force.

To further minimize impact force of the feet 16 and 18 of an exerciser using the apparatus with the bumper assembly, the ramp section 42 of each bumper assemblies 24 and 26 is provided with a resiliently compressible bumper strip 54. The bumper strip 54 is engaged by the foot of the exerciser using the apparatus and is compressed somewhat by the foot. In addition, a pad 58 is provided between the ramp section 42 and the main section 34 of the bumper assembly 26 to cushion sideward forces transmitted from the ramp section to the main section of the bumper assembly. The ramp section 42 is releasably connected with the main section 34 and pad 58 to enable ramp sections having different slopes to be used with the main section of a bumper assembly.

To stabilize the bumper assembly 26 and flexible sheet 12, a mat 82 with upper and lower side surfaces with a relatively high coefficient of friction is connected with the base 30 of the bumper assembly 26. The mat 82 extends from beneath the bumper assembly 26 along the flexible sheet 12 so that the weight of an exerciser 20 presses the flexible sheet 12 against the mat 82 and in turn presses the mat against the floor or other support surface. This enables forces to be transmitted from the bumper assembly 26 to the floor when the exerciser's foot 18 engages the bumper assembly 26.

When an exerciser 20 using the apparatus 10 has completed the exercises, the apparatus can be compactly stored. This may be done by disconnecting one of the bumper assemblies, that is, the bumper assembly 26 in FIG. 6, from the flexible sheet 12. The flexible sheet 12 is then rolled around the other bumper assembly 24. The flexible sheet 12, with the bumper assembly 24 connected thereto, and the disconnected bumper assembly 26 can then be stored in a minimum of space. Although the use of the flexible sheet 12 facilitates storage, a rigid sheet or base could be used if desired.

Having described the invention, the following is claimed:

1. An exercise apparatus for use in training for skating and other sports, said apparatus comprising:

a longitudinally extending flexible sheet having a length which is substantially greater than its width, said flexible sheet having a smooth glide surface along which the feet of a person can slide;

first bumper means releasably connected with said flexible sheet near a first end of said flexible sheet and extending transverse to the longitudinal extent of said flexible sheet for engaging a side of a foot of a person sliding in a first direction on the glide surface along the longitudinal extent of said flexible sheet;

said first bumper means including a first rigid base member disposed beneath said flexible sheet, a first rigid main section disposed above said flexible sheet, first fastener means interconnecting said first base member and said first main section to releasably clamp a portion of said flexible sheet between said first base member and said first main section, a first ramp section having side surface means sloping upwardly away from the glide surface on said flexible sheet toward said first main section at an acute angle to the glide surface for engaging the side of a foot of a person sliding in the first direction on the glide surface, and a first resilient means between said first ramp section and said first main section for cushioning forces applied against said first ramp section by a foot of a person using the exercise apparatus; and second bumper means releasably connected with said flexible sheet near a second end of said flexible sheet and extending transverse to the longitudinal extent of said flexible sheet for engaging a side of a foot of a person sliding in a second direction on the glide surface along the longitudinal extent of said flexible sheet;

said second bumper means including a second rigid base member disposed beneath said flexible sheet, a second rigid main section disposed above said flexible sheet, second fastener means interconnecting said second base member and said second main section to releasably clamp a portion of said flexible sheet between said second base member and said second main section anywhere along the length of said flexible sheet, a second ramp section having side surface means sloping upwardly away from the glide surface on said flexible sheet toward said second main section at an acute angle to the glide surface for engaging the side of a foot of a person sliding in the second direction on the glide surface, and a second resilient means between said second ramp section and said second main section for cushioning forces applied against said second ramp section by a foot of a person using the exercise apparatus.

2. An exercise apparatus as set forth in claim 1, said first resilient means including a first resilient pad disposed between said first ramp section and said first main section to cushion forces applied against said first ramp section by a foot of a person using the exercise apparatus, said second resilient means including a second resilient pad disposed between said second ramp section and said second main section to cushion forces applied against said second ramp section by a foot of a person using the exercise apparatus.

3. An exercise apparatus as set forth in claim 1 further including first releasable connector means disposed between said first ramp section and said first main section for releasably interconnecting said first ramp section and said first main section, and second releasable connector means disposed between said second ramp section and said second main section for releasably interconnecting said second ramp section and said second main section.

4. An exercise apparatus as set forth in claim 1 further including a first resiliently compressible bumper strip mounted on said first ramp section and having an upwardly sloping side surface against which force is applied by a foot of a person using the exercise apparatus, and a second resiliently compressible bumper strip mounted on said second ramp section and having an upwardly sloping side surface against which force is applied by a foot of a person using the exercise apparatus.

5. An exercise apparatus as set forth in claim 1 wherein said first base member has a flat upwardly facing major side surface disposed in engagement with a lower major side surface of said flexible sheet, said first main section having a flat downwardly facing major side surface disposed in engagement with an upper major side surface of said flexible sheet, said first fastener means being operable to press said major side surfaces of said first base member and said first main section against said flexible sheet to clamp a portion of said flexible sheet between said first base member and said first main section of said first bumper means, said second base member having a flat upwardly facing major side surface disposed in engagement with the lower major side surface of said flexible sheet, said second main section having a flat downwardly facing major side surface disposed in engagement with the upper major side surface of said flexible sheet, said second fastener means being operable to press said major side surfaces of said second base member and said second main section against said flexible sheet to clamp a portion of said flexible sheet between said second base member and said main section of said second bumper means.

6. An exercise apparatus as set forth in claim 1 further including a first flexible mat connected with said first bumper means and extending beneath said first ramp section and said flexible sheet, said first flexible mat extending past said first ramp section toward said second bumper means to a location at which said first flexible mat is disposed beneath only said flexible sheet, and a second flexible mat connected with said second bumper means and extending beneath said second ramp section and said flexible sheet, said second flexible mat extending past said second ramp section towards said first bumper means to a location at which said second flexible mat is disposed beneath only said flexible sheet.

7. An exercise apparatus for use in training for skating and other sports, said apparatus comprising:

a longitudinally extending base having a length which is substantially greater than its width, said base having a smooth glide surface along which the feet of a person can slide, and bumper means connected with said base near a first end of said base and extending transverse to the longitudinal extent of said base for engaging a side of a foot of a person sliding in a first direction on the glide surface along the longitudinal extent of said base, said bumper means including a main section disposed above said base, a first ramp section having side surface means sloping upwardly at a first angle, a second ramp section having side surface means sloping upwardly at a second angle, and releasable connector means disposed on said main section for releasably interconnecting one of said ramp sections and said main section to enable removal of said one of said ramp sections from said main section without removal of said main section from said base, said first and second ramp sections being interchangeably interconnectable with said main section, said side surface of said one of said ramp sections sloping upwardly away from the glide surface toward said main section and being engageable by the foot of a person sliding in the first direction on the glide surface.

8. An exercise apparatus as set forth in claim 7 wherein said base is a flexible sheet.

9. An exercise apparatus as set forth in claim 7 further including a resilient pad disposed between said one of said ramp sections and said main section of said bumper means to cushion forces applied against said one of said ramp sections by a foot of a person using the exercise apparatus.

10. An exercise apparatus as set forth in claim 7 further including a resiliently compressible strip mounted on said one of said ramp sections and having an upwardly sloping side surface against which force is applied by a foot of a person using the exercise apparatus.

11. An exercise apparatus as set forth in claim 7 further including anti-skid means connected with said bumper means and extending beneath said one of said ramp sections and said base, said anti-skid means extending past said ramp section to a location at which said anti-skid means is disposed beneath only said base to retain said base against movement relative to a support surface.

* * * * *